US005575671A

United States Patent [19]

Katsuma

[11] Patent Number: 5,575,671

[45] Date of Patent: Nov. 19, 1996

[54] LEVER-TYPE CONNECTOR

[75] Inventor: Takatoshi Katsuma, Yokkaichi, Japan

[73] Assignee: Sumitomo Wiring Systems, Ltd., Mie, Japan

[21] Appl. No.: 316,336

[22] Filed: Sep. 30, 1994

[30] Foreign Application Priority Data

Oct. 4, 1993 [JP] Japan ..... 5-273039

[51] Int. Cl.[6] ..... H01R 13/62

[52] U.S. Cl. ..... 439/157; 439/160

[58] Field of Search ..... 439/152–160, 439/372

[56] References Cited

U.S. PATENT DOCUMENTS

| | | | |
|---|---|---|---|
| 4,447,101 | 5/1984 | Gugliotti | 439/153 |
| 5,230,635 | 7/1993 | Takenouchi et al. . | |
| 5,257,942 | 11/1993 | Taguchi | 439/153 |
| 5,273,447 | 12/1993 | Heiney et al. | 439/160 |

FOREIGN PATENT DOCUMENTS

| | | |
|---|---|---|
| 4207565C1 | 12/1992 | Germany . |
| 4-29180 | 3/1992 | Japan . |
| 0558947A3 | 9/1993 | WIPO . |
| 0599332A1 | 6/1994 | WIPO . |

*Primary Examiner*—David L. Pirlot
*Attorney, Agent, or Firm*—Oliff & Berridge

[57] ABSTRACT

In a pair of lever-type connectors, a U-shaped lever including a pair of cam portions is rotatably provided in one of two connector housings to be connected to each other in such a manner that the lever straddles the connector housing, a pair of cam receiving pins respectively engageable with the cam portions are provided in the other connector housing. By rotating the lever reciprocatingly, the cam receiving pins are shifted so as to connect or disconnect the two connector housing to and from each other. The lever-type connector comprises: a pair of lever support shafts provided on and projecting from one of the connector housings and the lever, a pair of bearing hole portions respectively formed in the other of the connector housings and the lever and engageable with the lever support shafts; a pair of removal prevention portions formed in one of the lever support shafts and the bearing hole portions and projecting in the radial direction of one of the lever support shafts and the bearing hole portions; and a pair of engaging surfaces respectively provided in the other of the lever support shafts and the bearing hole portions, engageable with the removal prevention portions during the reciprocating rotational movement of the lever, and notches to allow the removal prevention portions to be inserted thereinto or removed therefrom at the disconnected position of the lever.

2 Claims, 5 Drawing Sheets

LEVER-TYPE CONNECTOR

BACKGROUND OF THE INVENTION

1. Field of the Invention

The present invention relates to a lever support structure for a lever-type connector which can be connected by use of the leverage of a lever.

2. Description of the Prior Art

The lever-type connector is advantageous in that the connection and removal thereof can be executed with a small force and, especially, it is often applied to a multipole connector which has 20 poles or more. The basic principle of the lever-type connector utilizes the leverage action of a lever and, as a structure for the lever-type connector, for example, there is known such a structure as shown in FIG. 7. On the left in FIG. 7, there is shown a female connector housing 1 which stores therein a large number of female terminals (not shown), while on the right there is shown a male connector housing 2 which stores therein a large number of male terminals and includes a hood portion 2*a* for receiving the female connector housing 1. While cam receiving pins 3 are respectively provided on the right and left side wall portions of the female connector housing 1, on the right and left side walls of a hood portion 2*a* of the male connector housing 2, there are formed slits 4 respectively for receiving the cam receiving pins 3.

Also, a U-shaped lever 5 is rotatably mounted to the male connector housing 2. A structure for mounting the lever 5 to the male connector housing 2 is arranged such that a pair of lever support shafts 2*b* are projected from the right and left wall portions of the male connector housing 2, two circular bearing holes 5*a* are respectively formed in the right and left side portions of the lever 5 and, as shown in FIG. 7, the lever support shafts 2*b* are inserted through the two bearing holes 5*a* of the lever 5, respectively.

On the back surface of the lever 5, there are formed two cam grooves 6 which are respectively engageable with the cam receiving pins 3. The cam grooves 6 are connected in communication with slits 4 when the lever 5 is held at such position as shown in FIG. 7. If the female connector housing 1 is inserted into the hood portion 2*a* of the male connector housing 2 and the lever 5 is rotated in a direction of an arrow shown in FIG. 7, then the cam grooves 6 of the lever 5 allows the cam receiving pins 3 and thus the female connector housing 1 to advance deeply into the hood portion 2*a* of the male connector housing 2, which completes the connection between the male and female connectors.

Now, in the process that the female connector housing 1 is moved into the hood portion 2*a* by turning the lever 5, due to the mutual fitting between the male and female terminals (not shown), an insertion load is applied to the operation of the lever 5. The insertion load increases as the turn of the lever advances. The operation force necessary to push the operation portion 5*b* of the lever 5 is increased in opposition to the increase in the insertion load. The increased operation force causes the operation portion 5*b* of the lever 5 to be flexed in a recessed manner, so that the arms 5*c* of the lever 5 are respectively extended outwardly. If the arms 5*c* are extended outwardly too much, then the arms 5*c* can be removed out of the lever support shaft 2*b*. As a countermeasure against such removal of the arms 5*c*, for example, there is known a technique in which a pair of right and left guide walls 7 are provided in the lower portion of the lever 5 of the male connector housing 2 so as to prevent the arms 5*c* from being widened outwardly when it is turned.

However, in the technique using the guide walls 7, since the width of the male connector housing 2 is increased by the widths of the guide walls 7, the whole structure of the connector housing becomes large in size.

Also, there is available a technique in which removal preventive washers are respectively mounted on the ends of the lever support shafts 2*b*. However, this technique increases the number of parts and also worsens the connector assembling operability.

SUMMARY OF THE INVENTION

In view of the above-mentioned conventional connectors, it is an object of the invention to provide a lever-type connector which suitably prevents a lever from being removed from a connector housing by means of a simple structure.

In attaining the above object, according to the invention, there is provided a lever-type connector in which, a U-shaped lever including a pair of cam portions is rotatably provided in one of connector housings of connectors to be connected to each other in such a manner that the lever straddles the connector housing, a pair of cam receiving portions respectively engageable with the cam portions are provided in the other connector housing, and by rotating the lever reciprocatingly, the cam receiving portion are shifted so as to connect or disconnect the two connectors to and from each other, the lever-type connector comprising: a pair of lever support shafts provided on and projected from one of the one connector housing and the lever, a pair of bearing hole portions respectively formed in the other of the one connector housing and the lever and engageable with the lever support shafts; a pair of removal preventive portions formed in one of the lever support shafts and the bearing hole portions and projecting in the radial direction of one of the lever support shafts and the bearing hole portions; and a pair of engaging surfaces respectively provided in the other of the lever support shafts and the bearing hole portions, engageable with the removal preventive portions during the reciprocating rotational movement of the lever, and notched partially to allow the removal preventive portions to be inserted thereinto or removed therefrom at the disconnected position of the lever.

According to the above structure, when the lever is mounted on the connector housing, the lever is positioned at the disconnected position of the two connectors and then the removal preventive portions provided in one of the lever support shafts and the bearing hole portions are inserted from the notched portions of the engaging surfaces provided in the other of the lever support shafts and the bearing hole portions. And, when the lever is operated in order to connect the two connectors to each other, the lever is rotated from the disconnected position toward the connected position of the two connectors. In doing so, with the connection of the two connectors, the lever is given an operation force in opposition to an insertion load acting on the lever, so that the lever is flexed. However, even if the lever is thus flexed to produce a force which acts in a direction to separate the lever support shafts and bearing hole portions from each other, the removal preventive portions are engaged with the engaging surfaces to thereby be able to prevent the lever support shafts and bearing hole portions from separating from each other.

As has been described heretofore, according to the invention, without increasing the size of the connectors or increasing the number of parts and the working man-hours, not only the mechanical strength of the lever can be maintained but also the lever can be prevented from being removed from the connector housing due to an operation force applied to the lever in opposition to an insertion load.

DETAILED DESCRIPTION OF THE PREFERRED EMBODIMENTS

Next, description will be given below of embodiments materializing the present invention with reference to the accompanying drawings.

<First Embodiment>

Figure 1:
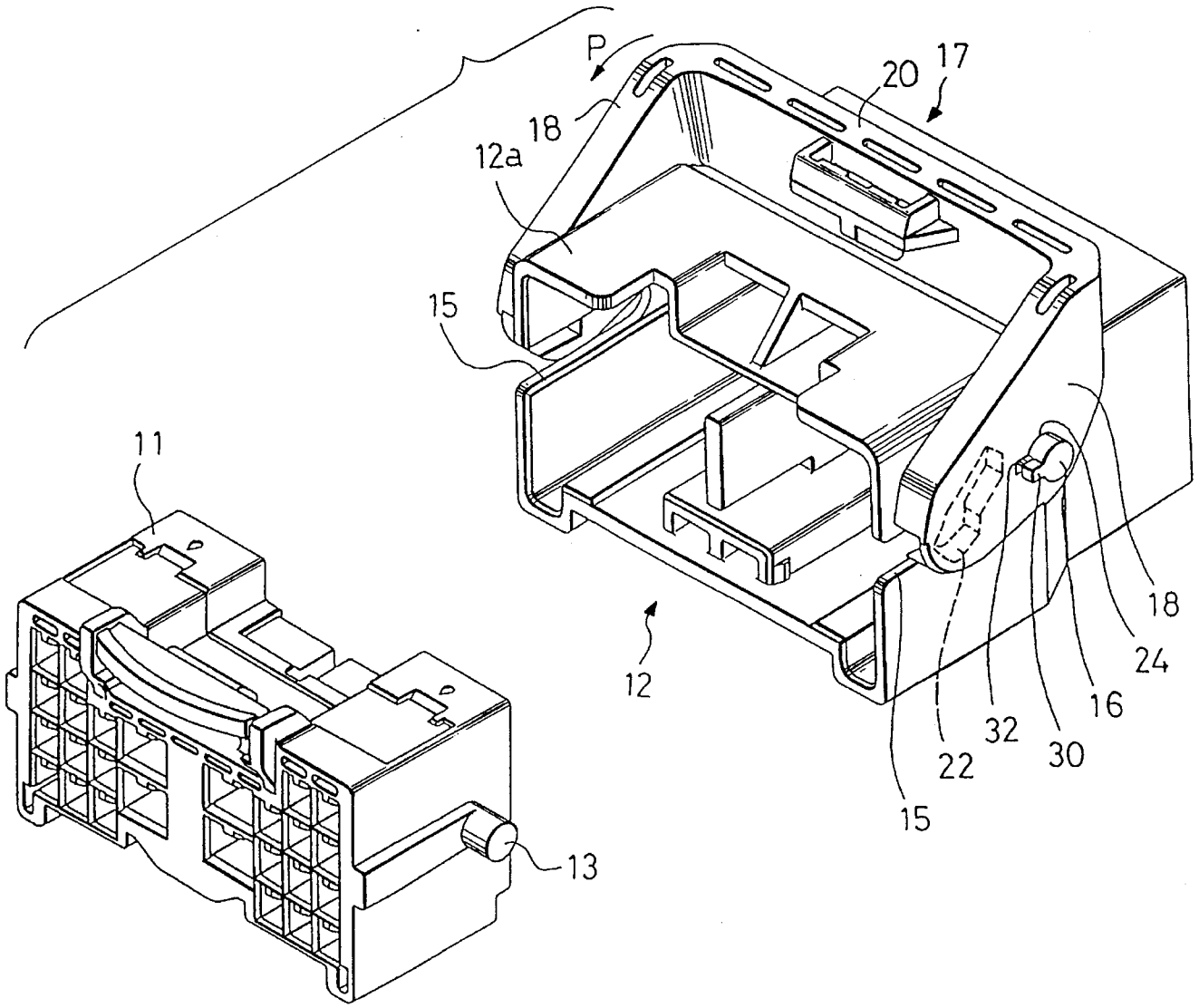
FIG. 1 is a perspective view of a first embodiment of a lever-type connector according to the invention, when the male and female connector housings thereof are separated from each other.

On the left in FIG. 1, there is shown a female connector housing 11 which stores therein female terminals (not shown), while on the right in FIG. 1 there is shown a male connector housing 12 which stores therein male terminals (not shown) and includes a hood portion 12*a*.

The female connector housing 11 is formed in such a size that allows itself to be inserted into the hood 12*a* of the male connector housing 12 and includes on the right and left side portions thereof a pair of laterally projecting cam receiving pins 13 which respectively correspond to cam receiving portions provided in the male connector housing 12 (only one of the cam receiving pins 13 is shown in FIG. 1).

Figure 2:
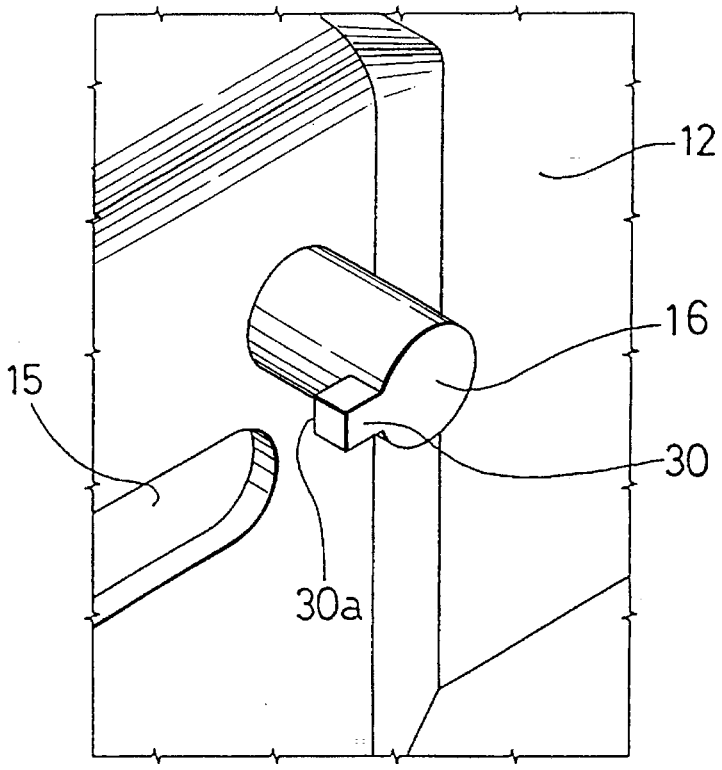
FIG. 2 is an enlarged perspective view of a lever support shaft used in the first embodiment.

On the other hand, the male connector housing 12 is formed in a box member which is open at the front surface thereof and includes a pair of guide grooves 15 which are respectively formed on the right and left side portions thereof in such a manner that, when the female connector housing 11 is inserted, the cam receiving pins 13 can be inserted into the guide grooves 15. On the right and left side portions of the male connector housing 12, as shown in FIGS. 1 and 2, a pair of lever support shafts 16 (only one of them is shown) are projected sideways, on which a lever 17 is mounted by means of a support structure (which will be described later).

The lever 17 is formed in a U-shaped member in which the ends of a pair of right and left arm portions 18 are connected to each other at an operation portion 20. Also, the lever 17 is mounted on the male connector housing 12 in such a manner that the two arm portions 18 respectively straddle the right and left side wall portions of the male connector housing 12. On the back sides (on the male connector housing 12 sides) of the two arm portions 18, there are formed cam grooves 22 corresponding to cam portions and, when the female connector housing 11 is inserted, the cam receiving pins 13 are moved into the cam grooves 22 respectively. While the cam receiving pins 13 are being inserted in the cam grooves 22, if the lever 17 is rotated from the disconnected position shown in FIG. 1 to the connected position (the position where the two connector housings are completely fitted with each other) rotated in a direction of an arrow P, then the cam grooves 22 move the female connector housing 11 to the inside of the hood portion 12*a* of the male connector housing 12 by means of the cam operation thereof to thereby connect the male and female terminals with each other and thus connect the two connectors with each other.

Figure 3:
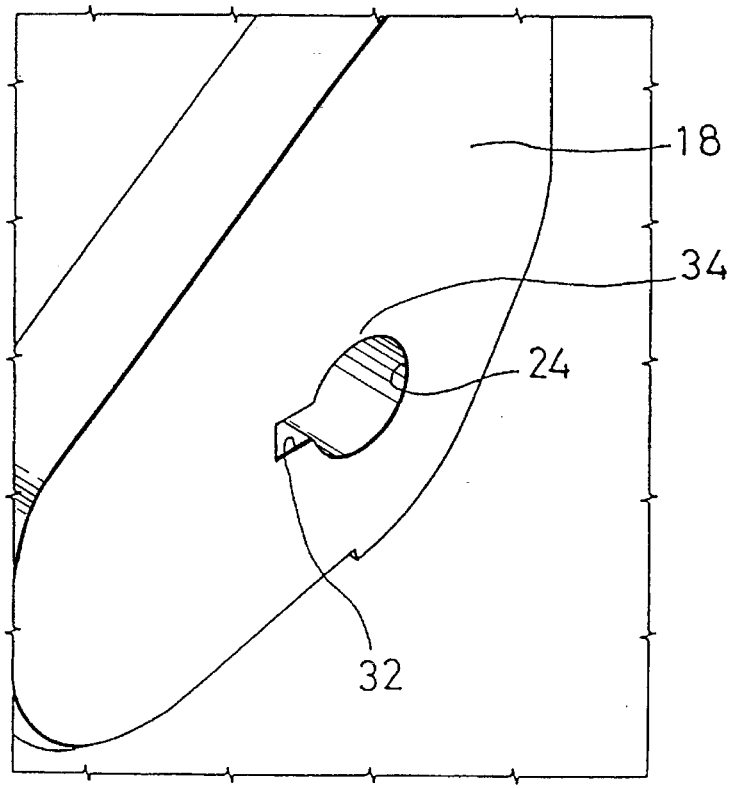
FIG. 3 is an enlarged perspective view of a bearing hole formed in the first embodiment.

Referring next to the support structure of the lever 17, in the two arm portions 18 of the lever 17, there are bearing holes 24 which are respectively fittable with the lever support shafts 16. Part of each bearing hole 24, as shown in FIG. 3, is cut in radially and axially to thereby provide a notch groove 32. On the other hand, each of the lever support shafts 16, as shown in FIG. 2, is formed in a cylindrical shape which is provided on and projected from the male connector housing 12 and includes in the leading end portion thereof a projection 30 (removal prevention portion) which is projected out radially and is insertable into the notch groove 32. However, the length of the lever support shaft 16 is so set that the projection 30 projects externally of the lever 17. Also, the notch grooves 32 and projections 30 are positioned in such a manner that they can be fitted with each other when the lever 17 is situated at the disconnected position of the two connectors. The outside surface of the arm portion 18 around the bearing hole 24 forms an engaging surface 34 which is engageable with the inner peripheral surface 30*a* of the projection 30.

The lever 17 having the above structure can be fitted with the lever support shafts 16 in the following manner:

That is, at first, the lever 17 is opposed to the male connector housing 12 according to the attitude of the male connector housing 12 at the disconnected position of the two connectors. And, while the two arm portions 18 are extended out, the notch grooves 32 are fitted with the projections 30 and the lever support shafts 16 are inserted into the bearing holes 24, respectively. As a result of this, the projections 30 respectively extend through the notch grooves 32 and project out onto the engaging surfaces 34 serving as the outside surfaces of the arm portions 18.

Next, to connect the two connectors with each other, the cam receiving pins 13 of the female connector housing 11 are passed through the guide grooves 15 of the male connector housing 12 and are then fitted into the cam grooves 22 of the lever 17 which is situated at the disconnected position shown in FIG. 1. And, if the thus fitted lever 17 is rotated in the direction of the arrow P from the disconnected position shown in FIG. 1 to the connected position, then the cam receiving pins 13 are guided by the cam grooves 22 and thus the male and female connectors are connected with each other. In this operation, with the insertion of the female connector into the male connector, an insertion load is increased and an operation force to be applied to the operation portion 20 is increased in opposition to the increased insertion load. This causes the operation portion 20 of the lever 17 to be flexed, thereby producing a force to spread the arm portions 18 (both sides) outwardly. However, because the projections 30 of the lever support shafts 16 are in engagement with the engaging surfaces 34 of the arm portions 18 around the bearing holes 24, even if the arm portions 18 are spread outward, the arm portions 18 are prevented from disengaging from the lever support shafts 16.

As has been described above, according to the first embodiment of the invention, since there is eliminated the need for provision of the guide walls that are used in the conventional connector, the size of the present connector can be reduced when compared with the conventional connector. Also, because the removal prevention of the lever 17 can be achieved without increasing the number of parts and the assembling man-hours, the manufacturing cost can be reduced and the assembling operation can be executed more efficiently.

<Second Embodiment>

Next, description will be given below of a second embodiment of a lever-type connector according to the invention. In the second embodiment, a securing structure for securing the lever support shafts and bearing holes to each other is different from that used in the first embodiment. Therefore, in the second embodiment, only the different portions thereof will be described here but the description of other portions is omitted here.

Figure 4:
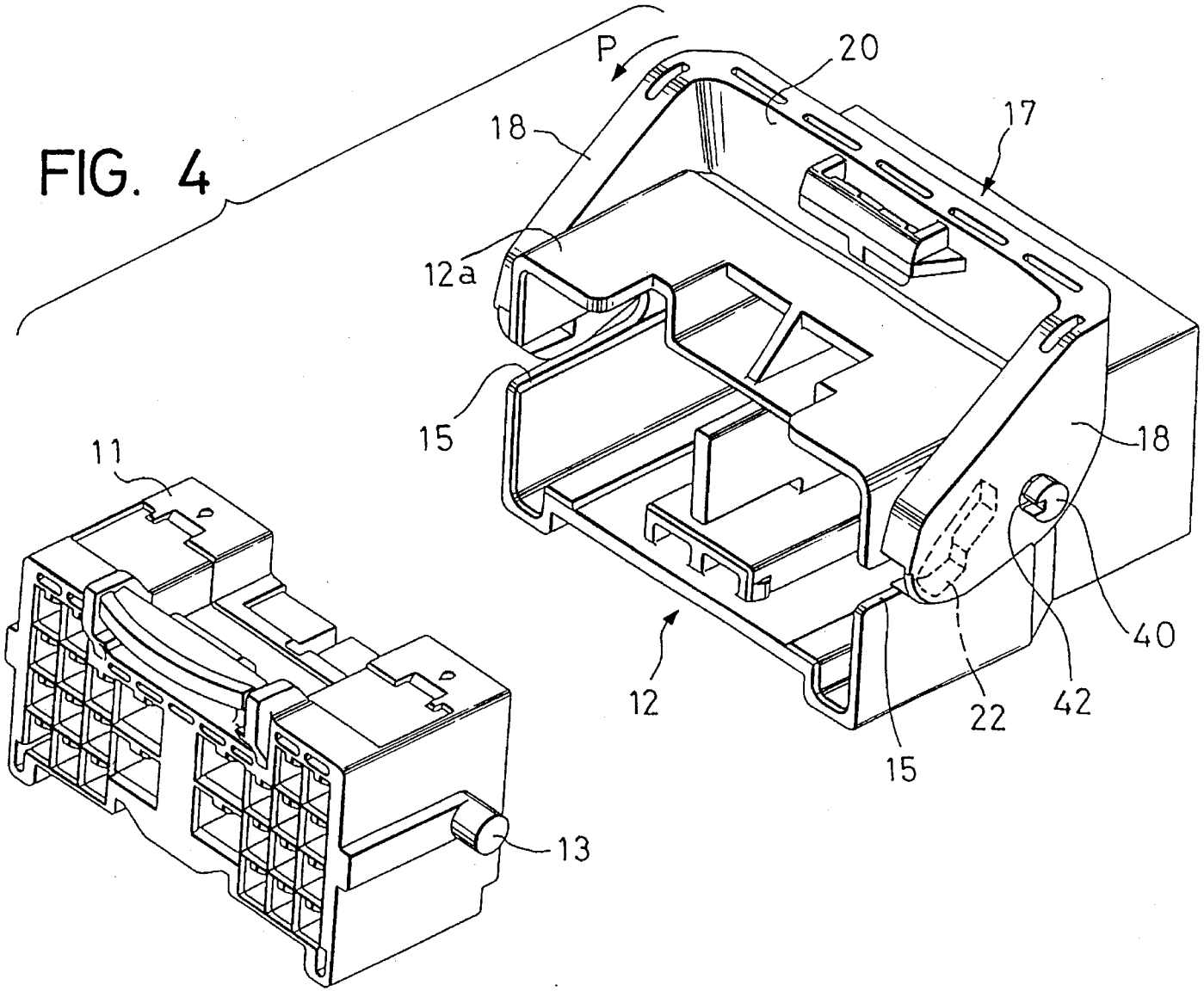
FIG. 4 is a perspective view of a second embodiment of a lever-type connector according to the invention, when the male and female connector housings thereof are separated from each other.
Figure 5:
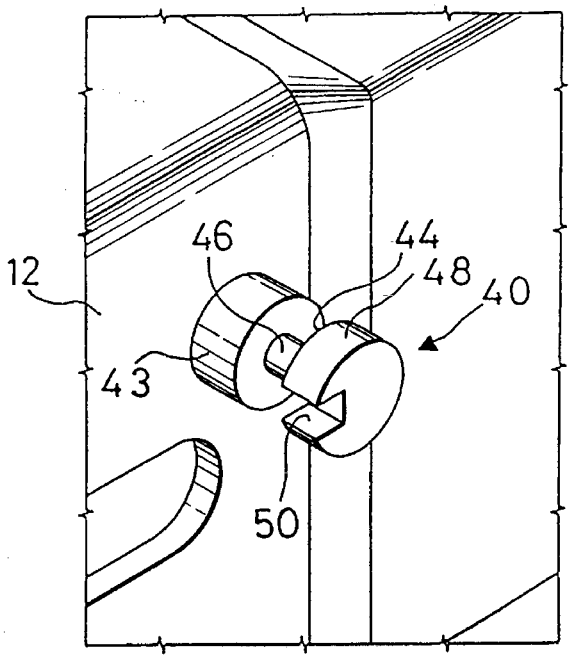
FIG. 5 is an enlarged perspective view of a lever support shaft used in the second embodiment.

As shown in FIG. 4, the lever 17 is rotatably supported by means of engagement between lever support shafts 40 and bearing holes 42. That is, the central portion of the lever support shaft 40, as shown in FIG. 5, is shaved over the whole periphery thereof to thereby form a reduced diameter portion 46. As a result of this, the lever support shaft 40 includes a base portion 43 and a removal prevention portion 48 with the reduced diameter portion 46 between them. And the removal prevention portion 48 includes a notch groove 50 which is formed in the diameter direction thereof. The depth of the notch groove 50 is so set that the bottom of the notch groove 50 is level with the outside diameter of the reduced diameter portion 46. A projection 52 (to be described later) provided in the bearing hole 42 is inserted through the notch groove 50 and, when the lever 17 is rotated, the projection 52 is rotated along the periphery of the reduced diameter portion 46. Therefore, the inner peripheral surface of the removal prevention portion 48 provides an engaging surface 44 which prevents the lever 17 from being removed.

Figure 6:
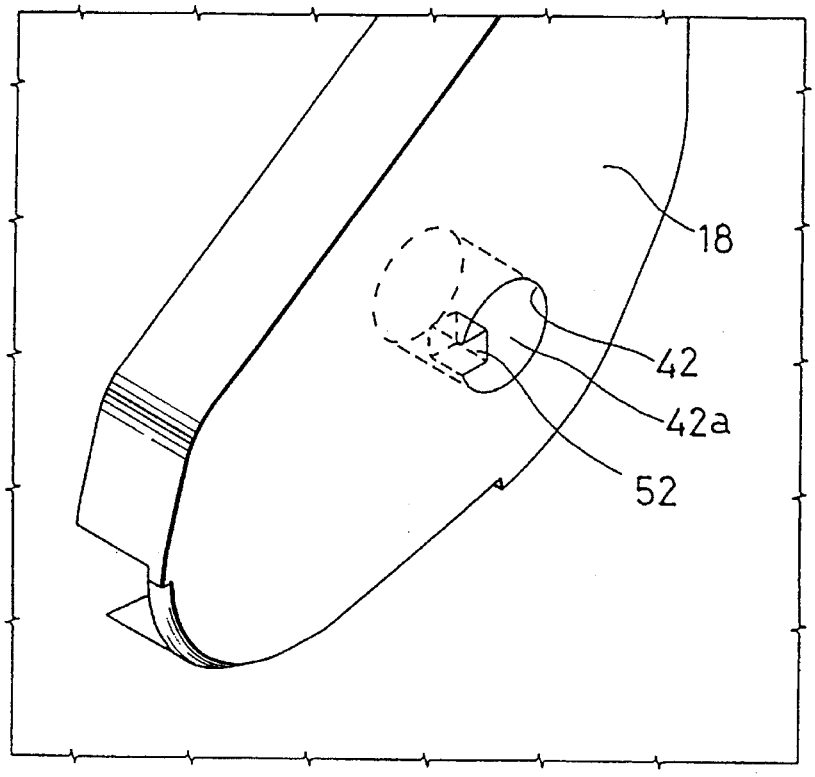
FIG. 6 is an enlarged perspective view of a bearing hole formed in the second embodiment.
Figure 7:
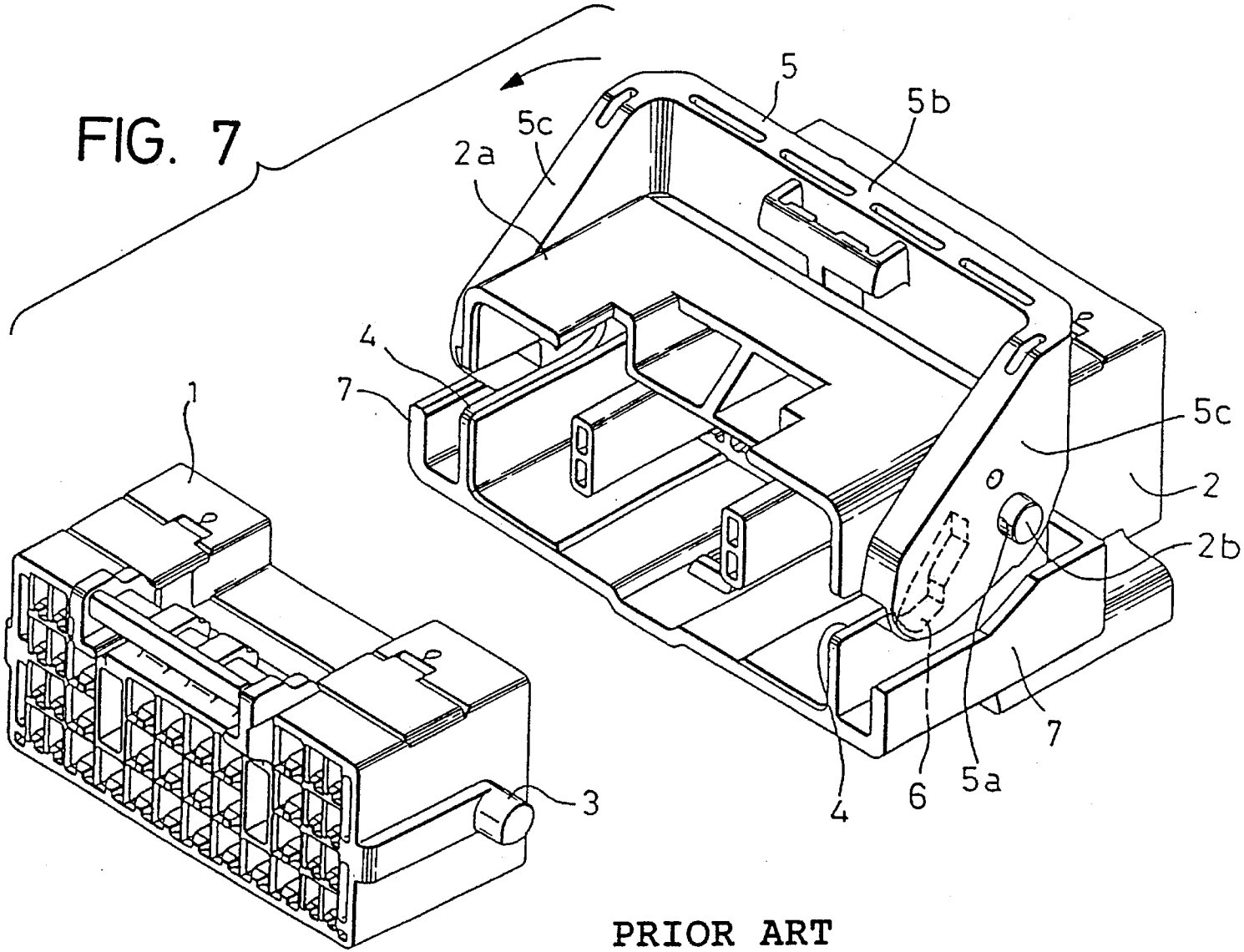
FIG. 7 PRIOR ART
FIG. 7 is a perspective view of a conventional lever-type connector.

On the other hand, as shown in FIG. 6, on the inner peripheral surface 42*a* of the bearing hole 42, there is provided the projection 52 that projects out toward the axis thereof. The outer end face of the projection 52 is formed level with the surface of the arm portion 18. Also, the width of the projection 52 is set slightly smaller than the width of the reduced diameter portion 46 and the projecting dimension of the projection 52 is set so that the projection 52 can be moved along the peripheral surface of the reduced diameter portion 46. The position of the projection 52 is set such that the projection 52 can pass through the notch groove 50 of the removal prevention portion 48 at the disconnected position of the lever 17.

In the second embodiment structured in the above manner as well, even if the operation portion 20 is flexed due to the operation force applied to the operation portion 20 and thus the arm portions 18 are deformed in a direction to come off outwardly from the lever support shafts 40, there is no possibility that the arm portions 18 can come off the lever support shafts 40 because the movement of the arm portions 18 in the axially outward direction thereof is restricted by the engaging surfaces 44 of the lever support shafts 40.

Therefore, the second embodiment can also provide a similar removal prevention effect to the first embodiment.

What is claimed is:

1. A lever-type connector in which a U-shaped lever including two cam portions is rotatably mounted to straddle a first connector housing connectable to a second connector housing, said lever being rotatable between at least a disconnecting position in which the first and second connector housings can be separated and a connecting position in which the first and second connector housings can be joined, two cam receiving pins respectively engageable with the two cam portions of the lever and provided on the second connector housing, the lever being selectively rotatable to shift the cam receiving pins to selectively connect and disconnect the connector housings to and from each other, said lever-type connector comprising:

a pair of lever support shafts respectively provided on and projecting from one of said first connector housing and said lever, and a pair of bearing hole portions respectively formed in the other of said first connector housing and said lever and engageable with said lever support shafts for rotatably supporting said lever;

a pair of removal prevention portions formed in one of said lever support shafts and said bearing hole portions and radially projecting relative to an axial direction of said lever support shafts; and a pair of engaging surfaces respectively provided in the other of said lever support shafts and said bearing hole portions, said pair of engaging surfaces each having a notch with a size and a shape corresponding to one of said pair of removal prevention portions, said engaging surfaces being in contact with said removal prevention portions in the connecting position of said lever, and said notches being aligned with said pair of removal prevention portions in the disconnecting position of said lever to allow said lever to be removed by spreading said lever outward in the axial direction of said lever support shafts in the disconnecting position such that each of said removal prevention portions passes through a respective one of said engaging surfaces.

2. A lever-type connector, comprising:

first and second connector housings to be connected with each other;

a lever including two cam portions, said lever being rotatably mounted on said first connector housing such that said lever straddles said first connector housing, said lever being rotatable reciprocally between at least a disconnecting position in which the first and second connector housings can be separated and a connecting position in which the first and second connector housings can be joined;

two cam receiving pins provided on said second connector housing and respectively engageable with said two cam portions of said lever such that said lever is selectively rotatable to shift said cam receiving pins to selectively connect and disconnect said first and second connector housings to and from each other;

a pair of lever support shafts respectively provided on and projecting from one of said first connector housing and said lever, wherein a central portion of each of said lever support shafts is a reduced diameter portion;

a pair of bearing hole portions respectively formed in the other of said first connector housing and said lever and engageable with said lever support shafts for rotatably supporting said lever;

a pair of removal prevention portions formed on an outer portion of said lever support shafts and radially projecting relative to an axial direction of said pair of lever support shafts, wherein a depth of each of said removal prevention portions is dimensioned such that a bottom of each of said removal prevention portions is level with an outside diameter of said reduced diameter portion, and wherein a length of each of said lever support shafts is dimensioned such that the outer portion thereof projects outward from said lever; and a pair of engaging surfaces respectively provided in the other of said lever support shafts and said bearing hole portions, said removal prevention portions contacting said pair of engaging surfaces during reciprocating rotational movement of said lever, and said pair of engaging surfaces each including a notch having a size and shape corresponding to one of said pair of removal prevention portions to allow said removal prevention portions to be inserted into or removed from said notches in the disconnecting position of said lever.

* * * * *